United States Patent [19]

Norris

[11] 4,034,213

[45] July 5, 1977

[54] ILLUMINATING INSERT FOR A DRINKING GLASS

[75] Inventor: Frank John Norris, Ossining, N.Y.

[73] Assignee: The Raymond Lee Organization, Inc., New York, N.Y.

[22] Filed: July 14, 1975

[21] Appl. No.: 595,386

[52] U.S. Cl. ..... 240/6.4 G; 240/10.65
[51] Int. Cl.[2] ..... F21V 33/00; F21L 11/00
[58] Field of Search ..... 240/2 LC, 6.4 G, 10.65

[56] References Cited

UNITED STATES PATENTS

| | | | |
|---|---|---|---|
| 2,663,866 | 12/1953 | Simpson | 240/6.4 G X |
| 2,745,947 | 5/1956 | Sansous | 240/6.4 G |
| 3,878,386 | 4/1975 | Douglas | 240/2 LC X |

*Primary Examiner*—George H. Miller, Jr.
*Attorney, Agent, or Firm*—Stephen Wyden

[57] ABSTRACT

A battery pack with a suction cup for mounting in a glass connected to a cap containing a light emitting diode and magnifying lens with an insert between the pack and cap for decoration.

3 Claims, 8 Drawing Figures

ILLUMINATING INSERT FOR A DRINKING GLASS

I have invented a new and novel illuminating insert for a drinking glass. My insert will permit a user to add a new dimension to the pleasures of drinking. By producing a soft light, the user can see the drink in the glass and if the room is very dim, the insert in the glass may provide a soft, illuminating glow around the user, further providing a pleasant atmosphere when used.

My invention can be understood in view of the accompanying figures.

Figure 1:
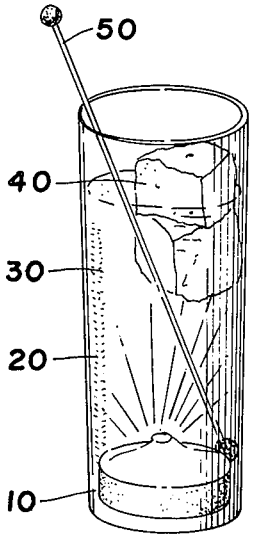
FIG. 1 shows the insert in use.

In FIG. 1, the illuminating insert 10 is inside a glass 20 containing a drink 30, ice 40 and a mixing stick 50.

Figure 2:
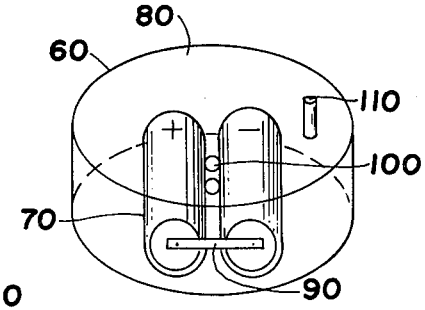
FIG. 2 shows the battery pack molded in plastic.

In FIG. 2 the battery pack 60 component of the insert 10 of FIG. 1 is seen two mercury batteries 70 such as mallory MP401-1.4V are mounted in a molding plastic 80 such as polyester casting resin, connected in series 90 and connected to battery terminals 100. A slot 110 to receive a positioning rod is formed in the molding plastic 80.

Figure 3:
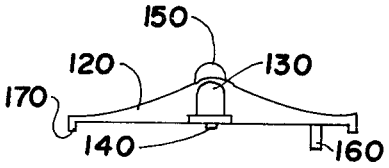
FIG. 3 shows the light emitting diode cap.

In FIG. 3, the light emitting diode cap 120 housing contains a light emitting diode (LED) 130 over and electrically connected to a contact 140 for connecting to the batteries 70 of FIG. 2. A magnifying lens 150 diffuses the light produced by the diode and a positioning rod 160 when inserted in the slot 110 of the battery pack 60 of FIG. 2 insures the correct alignment of the battery contacts 100 of FIG. 2 with the D contacts 140 of the cap. A rim 170 seals the cap 120 on the battery pack 60 of FIG. 2.

Figure 4:
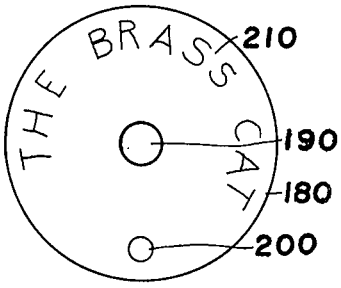
FIG. 4 shows a decorative insert that can be inserted under the cap.

In FIG. 4, an insert disc 180 has a large opening 190 for the LED contacts (140 of FIG. 3) and a small opening 200 for the positioning rod (160 of FIG. 3) to pass through. The surface of the disc 180 can be marked with a decorative design 210 and, at the same time, the disc hides the battery pack (60 of FIG. 2) from view.

Figure 5:
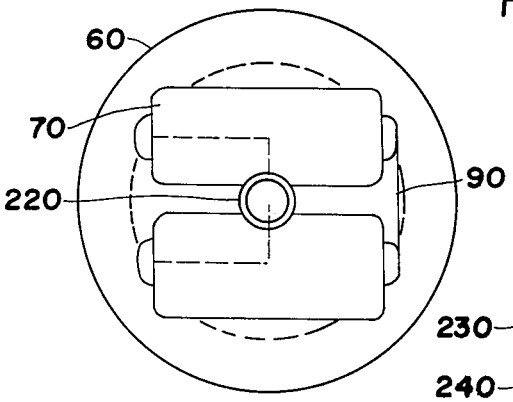
FIG. 5 is a top view of one version of the battery pack.
Figure 6:
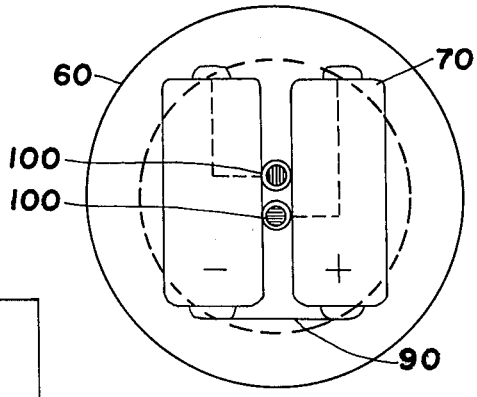
FIG. 6 is a top view of another version of the battery pack.

In FIGS. 5 and 6, the battery pack 60 contains the batteries 70 that are connected 90 together and connected to a single terminal 220 in FIG. 5 and to a double terminal 100 in FIG. 6.

Figure 7:
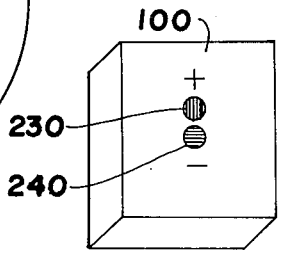
FIG. 7 is a section of a battery pack showing the battery terminals.

In FIG. 7, the double terminal 100 consists of an anode terminal 230 and a cathode terminal 240. The anode 230 is marked in red and the cathode 240 is marked in blue.

Figure 8:
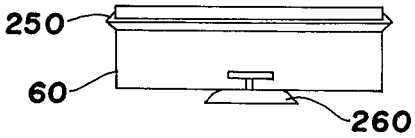
FIG. 8 is a side view of the battery pack.

In FIG. 8, the battery pack 60 has a ridge 250 that seals with the rim 170 of FIG. 3 to keep water and other liquids away from the electrical contacts and has a suction cup 260 mounted in the base of the pack 60 to secure the pack 60 to the bottom of a glass 20 in FIG. 1.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An illuminating insert for a drinking glass, comprising:

a terminal, a first mercury battery connected to the terminal, a second mercury battery connected in series to the first mercury battery, the second battery connected to the terminal, whereby the electrical circuit can be completed, the terminal, batteries and connections mounted in a molding plastic, the molding plastic forming a slot, and a light emitting diode cap physically and electrically connectable to the terminals.

2. The battery pack of claim 1, wherein the molding plastic forms a rim 250 and a suction cup is mounted in the base of the battery pack.

3. The cap of claim 1, comprising:

a housing forming a rim and a positioning rod, whereby the cap can be positioned on the battery pack, a light emitting diode (LED) mounted in the cap, a contact mounted in the cap and electrically connected to the LED, whereby the LED can be connected to the batteries in the battery pack, and a magnifying lens mounted in the cap over the LED, whereby the light produced by the LED may be diffused.

* * * * *